US007237972B2

(12) United States Patent
Kanari et al.

(10) Patent No.: US 7,237,972 B2
(45) Date of Patent: Jul. 3, 2007

(54) AUTOMATIC MECHANICAL PENCIL AND METHOD OF ASSEMBLY THEREOF

(75) Inventors: Hiroyuki Kanari, Fukushima-ken (JP); Yasuhiro Sanpei, Fukushima-ken (JP)

(73) Assignee: Micro Co., Ltd. (JP)

( * ) Notice: Subject to any disclaimer, the term of this patent is extended or adjusted under 35 U.S.C. 154(b) by 0 days.

(21) Appl. No.: 11/477,851

(22) Filed: Jun. 29, 2006

(65) Prior Publication Data

US 2007/0025801 A1 Feb. 1, 2007

(30) Foreign Application Priority Data

Jul. 20, 2005 (JP) ..... 2005-209432

(51) Int. Cl.
*B41K 21/22* (2006.01)

(52) U.S. Cl. ..... 401/92

(58) Field of Classification Search ..... 401/92–94, 401/55

See application file for complete search history.

(56) References Cited

U.S. PATENT DOCUMENTS 3,947,133 A * 3/1976 Kageyama et al. ..... 401/54
4,538,934 A * 9/1985 Brunner ..... 401/53
6,254,296 B1 * 7/2001 Sheu ..... 401/92

FOREIGN PATENT DOCUMENTS

JP 6218296 7/1993

* cited by examiner

*Primary Examiner*—Huyen Le
(74) *Attorney, Agent, or Firm*—Adams & Wilks

(57) ABSTRACT

An automatic mechanical pencil has a tubular piece removably connected to a barrel cylinder, and a slider for frictionally holding a lead and being movably disposed in a front portion of the tubular piece. A lead chuck is disposed in the barrel cylinder for releasably holding the lead so as to allow forward movement of the lead but prevent backward movement thereof. A first spring urges the slider forward and the lead chuck backward so that when a writing front end of the writing instrument is released from a writing surface, the lead is automatically fed by urging the slider forward. A lead reservoir is disposed rearwardly of the lead chuck to supply the lead to the lead chuck. The lead reservoir has a reservoir main body, a pipe holder connected to a front end of the reservoir main body and having a guide projection, and a stopper disposed around an outer periphery of the pipe holder and having a receiving groove engageable with the guide projection. A second spring urges the reservoir main body and the stopper of the lead reservoir so that the reservoir main body and the stopper move relatively in the axial direction of the barrel cylinder.

20 Claims, 5 Drawing Sheets

AUTOMATIC MECHANICAL PENCIL AND METHOD OF ASSEMBLY THEREOF

BACKGROUND OF THE INVENTION

1. Field of the Invention

The present invention relates generally to writing instruments and, more specifically, to an automatic mechanical pencil in which lead is automatically fed when a front end of the automatic mechanical pencil is separated or lifted from a writing surface during a writing operation. The present invention also relates to a method of assembling the automatic mechanical pencil.

2. Background Information

A conventional automatic mechanical pencil in which lead is automatically fed when a front end of the automatic mechanical pencil is separated or lifted from a writing surface during a writing operation is disclosed in, for example, JP-A-62-18296. However, the conventional automatic mechanical pencil has many parts and a complicated structure, is expensive to manufacture, and assembly thereof is cumbersome.

SUMMARY OF THE INVENTION

It is an object of the present invention to provide an automatic mechanical pencil which has a simple construction and which comprises a small number of parts so that it may be made economically and used in a convenient manner.

In another aspect, the present invention provides a simple method for assembling the automatic mechanical pencil of the present invention.

The foregoing and other objects of the present invention are carried out by an automatic mechanical pencil having a barrel cylinder, a tubular piece removably connected to the barrel cylinder, and a slider for frictionally holding a lead and being movably disposed in a front portion of the tubular piece. A lead chuck is disposed in the barrel cylinder rearwardly of the slider for releasably holding the lead so as to allow forward movement of the lead but prevent backward movement thereof, the lead chuck being movably disposed to undergo movement in an axial direction of the barrel cylinder. A first spring urges the slider forward and the lead chuck backward so that when a writing front end of the writing instrument is released from a writing surface, the lead is automatically fed by urging the slider forward.

A lead reservoir is disposed rearwardly of the lead chuck to supply the lead to the lead chuck. The lead reservoir has a reservoir main body, a pipe holder connected to a front end of the reservoir main body and having a guide projection, and a stopper disposed around an outer periphery of the pipe holder and having a receiving groove engageable with the guide projection of the pipe holder. A second spring urges the reservoir main body and the stopper of the lead reservoir so that the reservoir main body and the stopper move relatively in the axial direction of the barrel cylinder.

In a preferred embodiment, the pipe holder has an engagement groove, and the lead chuck has an enlargeable end having an engagement projection engageable in the engagement groove of the pipe holder. Preferably, the first spring comprises a slider spring disposed between the slider and the lead chuck, and the second spring comprises a knocking spring disposed between the stopper and the lead reservoir main body.

The tubular piece preferably comprises a tapered member and a connecting cylinder defining an integral structure formed from a single piece of material. The connecting cylinder has a first threaded portion for threaded engagement with a second threaded portion formed at a front end of the barrel cylinder. The first threaded portion is disposed between a front end of the connecting cylinder and a rear portion of the tapered member.

In another aspect, the present invention is directed to a method for assembling the automatic mechanical pencil according to the present invention. A primary unit body is formed by connecting the pipe holder to the front end of the lead reservoir main body, fitting the second spring and the stopper to an outer periphery of the pipe holder, and engaging the guide projection of the pipe holder with the receiving groove of the stopper so that the lead reservoir main body and the stopper are relatively movable in the axial direction. A secondary unit body is formed by connecting the lead chuck to the pipe holder of the primary unit body so as to allow forward movement of the lead but prevent backward movement thereof. A tertiary unit is formed by mounting the tubular piece with its tapered member having the slider movably disposed therein around an outer periphery of the lead chuck. Thereafter, the barrel cylinder is connected to the connecting cylinder of the tubular piece in the tertiary unit.

BRIEF DESCRIPTION OF THE DRAWINGS

The foregoing summary, as well as the following detailed description of a preferred embodiment of the invention, will be better understood when read in conjunction with the accompanying drawings. For the purpose of illustrating the invention, there is shown in the drawings an embodiment which is presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Figure 1:
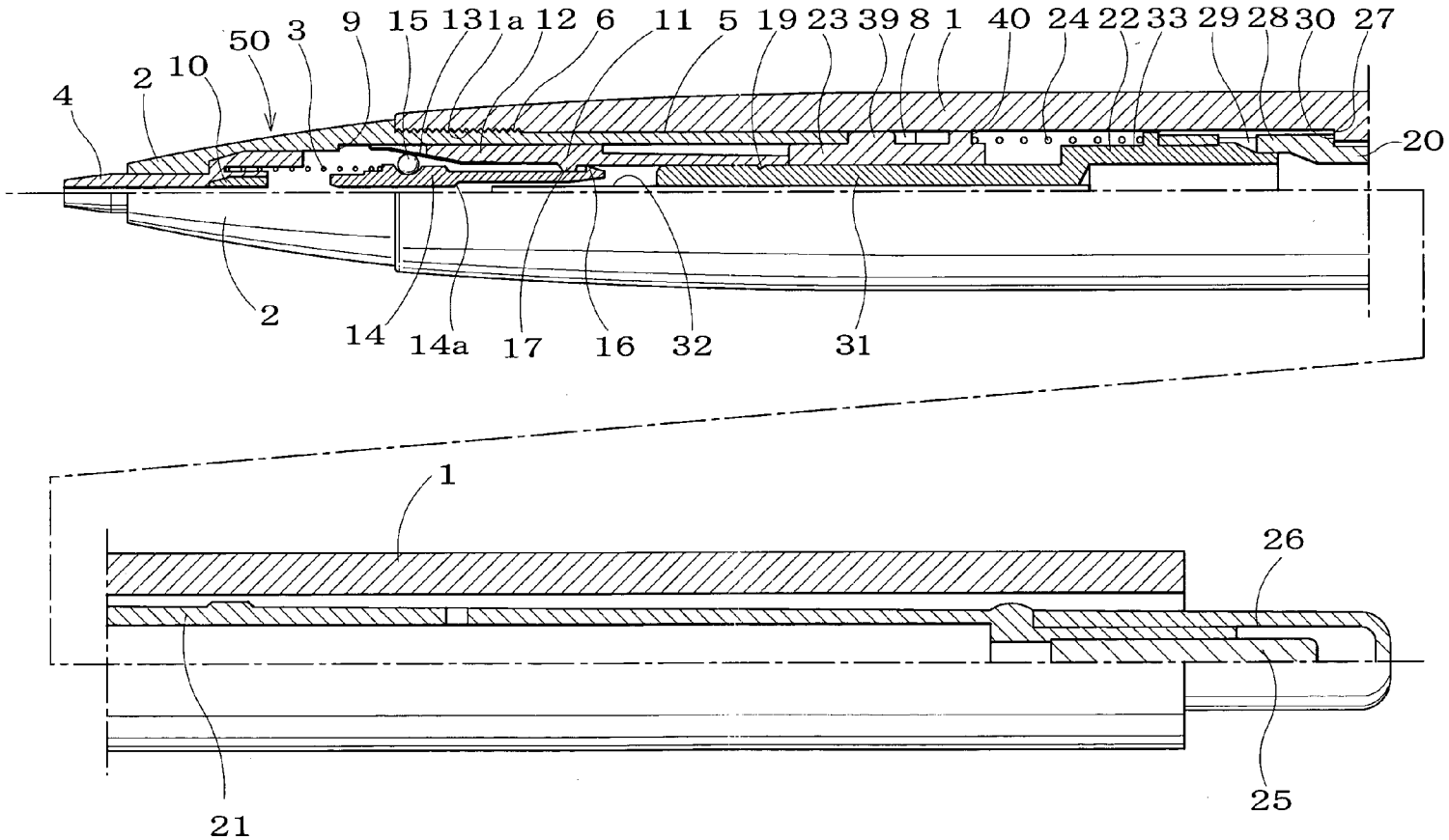
FIG. 1 is a partial cross-sectional front view showing an embodiment of an automatic mechanical pencil according to the present invention with certain parts omitted for clarification purposes.

Referring now to the drawings in detail, wherein like numerals are used to indicate like elements throughout, there is shown in FIGS. 1–12 one embodiment of a writing instrument in the form of an automatic mechanical pencil embodying the principles of the present invention. As shown in FIG. 1, the automatic mechanical pencil comprises a tubular piece 50 removably attached to a front end of a barrel cylinder 1. As used herein, the term "cylinder" means a tubular member as well known and used in the writing instrument art.

Figure 2:
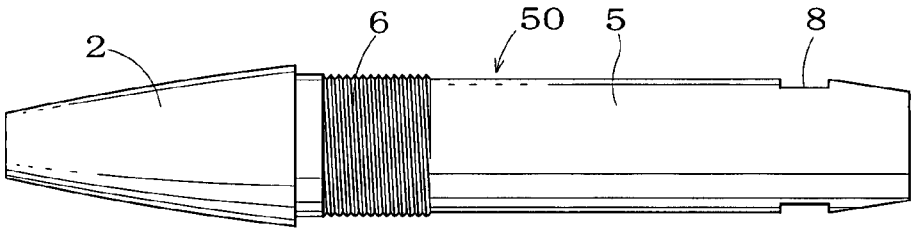
FIG. 2 is a front view of a tubular piece in the automatic mechanical pencil shown in FIG. 1.
Figure 3:
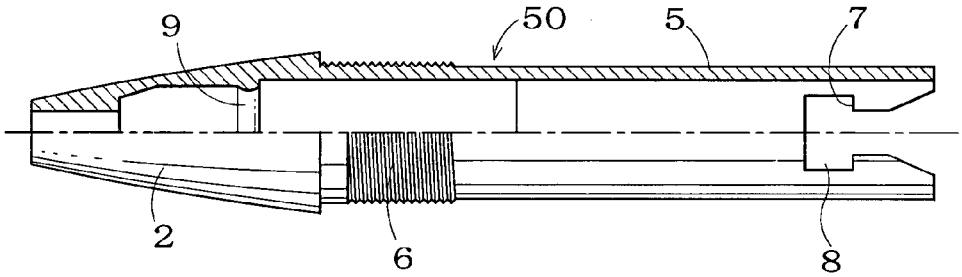
FIG. 3 is a partial cross-sectional side view of the tubular piece shown in FIG. 2.

As shown in FIGS. 1–3, the tubular piece 50 comprises a generally conical-shaped tapered member 2 and a connecting cylinder 5 which extends rearwardly from a rear portion of the tapered member 2 in the axial direction of the barrel cylinder 1. The connecting cylinder 5 extends into the barrel cylinder 1 and has an engagement hole 8 which opens rearwardly and has engagement edges 7. In this embodiment, the barrel cylinder 1 and the connecting cylinder 5 are detachably connected together by a screw coupling. More specifically, a threaded portion 6 is formed at a front end of the connecting cylinder 5 and is disposed between the rear portion of the tapered member 2 and the front end of the connecting cylinder 5 for threaded engagement with a threaded portion 1*a* formed at the front end of the barrel cylinder 1. It will be appreciated by those of ordinary skill in the art that the barrel cylinder 1 and the connecting cylinder 5 can be detachably connected together by other types of detachable connecting structure, such as a snap-fit coupling and the like. In this embodiment, the tapered member 2 and the connecting cylinder 5 of the tubular piece 50 define an integral structure formed from a single piece of material. It is understood, however, that the tapered member 2 and the connecting cylinder 5 of the tubular piece 50 can be formed separately from the same or different materials and then connected together to form an integral structure.

A slider 4 is movably disposed at the front portion of the tapered member 2 to undergo movement in the axial direction between retracted and advanced positions. The slider 4 is urged forwardly by a slider spring 3 and has a holding portion 10 which frictionally holds the writing instrument lead as conventionally known. The holding portion 10 is made of rubber, elastic clamping pieces, etc. During normal use of the writing instrument, the slider 4 gradually retracts with wear or consumption of the lead, and when the writing front end of the writing instrument is released from the writing surface, the slider 4 advances by the action of the slider spring 3, whereby the lead can be fed and the writing instrument functions as an automatic mechanical pencil.

In the tubular piece 50, a lead chuck 11 is movably disposed to undergo movement in the axial direction, and the lead chuck 11 is located rearwardly of the slider 4. The lead chuck 11 may be a ball chuck mechanism or other known mechanism constructed to effect forward movement of the lead but prevent backward movement thereof. In the example shown in FIGS. 1 and 4, the lead chuck 11 comprises a ring 13 provided at the front part of a cylindrical chuck main body 12, and a plurality, usually two, of chuck elements 14,14 partially surrounding the lead and inserted into the ring 13. Each of the chuck elements 14,14 has an inner stepped part 14*a*. The ring 13 is flared outwardly in the forward direction, and one or more balls 15 are interposed between the flared portion of the ring 13 and the chuck elements 14,14.

When the lead retracts, the one or more balls 15 shift to a small diameter part of the ring 13 to releasably clamp the lead, and when the lead advances, the one or more balls 15 shift to a large diameter part of the ring 13 to release the clamped lead to permit advancement thereof. At the rear ends of the chuck elements 14,14 and on the inner face of the chuck main body 12, detachment-preventing projections 16,17 are formed which abut against each other when the chuck elements advance, thereby preventing detachment of the chuck elements.

Figure 4:
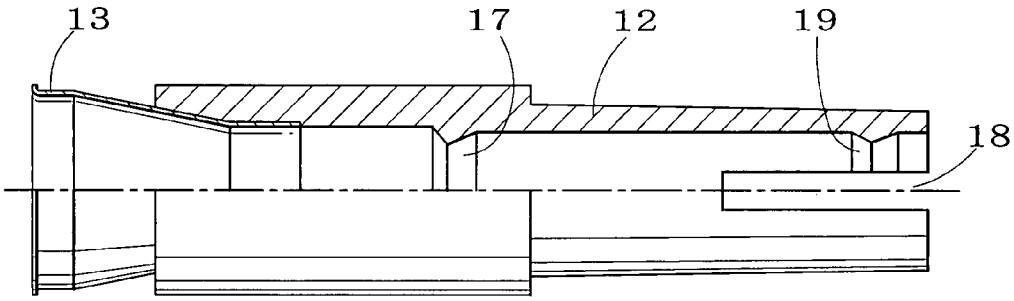
FIG. 4 is a partial cross-sectional front view showing a chuck main body of a lead chuck in the automatic mechanical pencil shown in FIG. 1.

As shown in FIG. 4, at the rear end of the chuck main body 12 of the lead chuck 11, a slit 18 is formed so that the rear end of the chuck main body 12 can be resiliently enlarged, and an engagement projection 19 projects inwardly from the inner periphery of the chuck main body 12. The lead chuck 11 is movable in the axial direction and urged backward or rearward by the slider spring 3 which constitutes a first urging means. As further described below, during a knocking operation, the chuck main body 12 advances or moves in the axial direction until the front end of the ring 13 abuts against a stepped portion 9 (FIG. 3) of the tapered member 2, but the chuck elements 14,14 can further advance in the axial direction.

Figure 5:
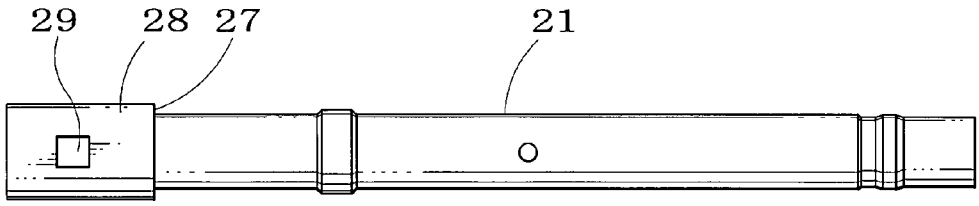
FIG. 5 is a front view of a lead reservoir body in the automatic mechanical pencil shown in FIG. 1.
Figure 6:
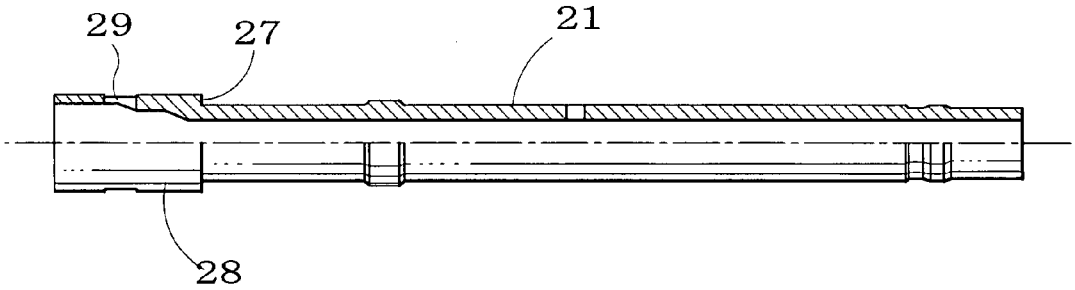
FIG. 6 is a partial cross-sectional side view of the lead reservoir body shown in FIG. 5.

A lead reservoir 20 is disposed rearwardly of the lead chuck 11 for undergoing movement in the axial direction to feed the lead to the lead chuck 11. With reference to FIGS. 5–10, the lead reservoir 20 has a reservoir main body 21 disposed in the barrel cylinder 1, a pipe holder 22, a stopper 23 and a knocking spring 24. An eraser 25 is removably attached at the rear end of the reservoir main body 21. A knocking member 26 in the form of a cap is removably inserted between the rear end of the reservoir main body 21 and the rear end of the barrel cylinder 1 so as to cover the eraser 25. The knocking member 26 is movably disposed at the rear end of the barrel cylinder 1 and engages with the rear end of the lead reservoir main body 21. As shown in FIGS. 5–6, a large diameter portion 28 is formed at the front part of the reservoir main body 21 via an outer stepped portion 27, and an engagement hole 29 is formed in the large diameter portion 28. The outer stepped portion 27 engages with an inner stepped portion 30 formed on the inner surface of the rear end of the barrel cylinder 1.

Figure 7:
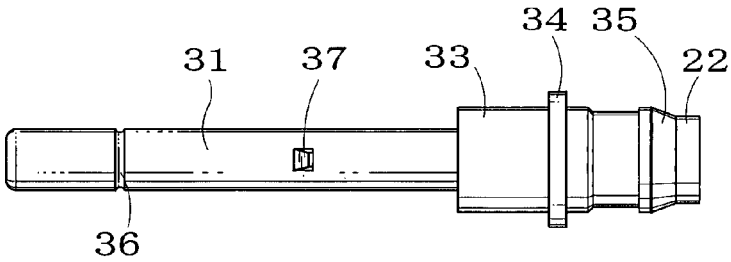
FIG. 7 is a front view of a pipe holder in the automatic mechanical pencil shown in FIG. 1.
Figure 8:
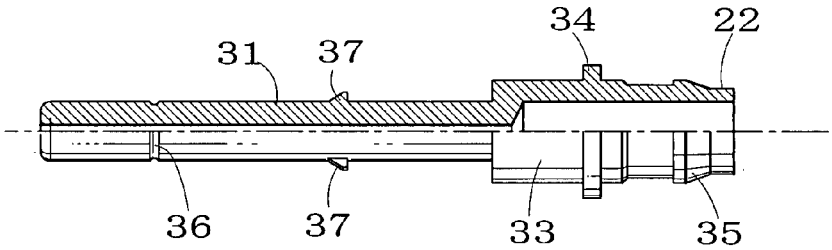
FIG. 8 is partial cross-sectional side view of the pipe holder shown in FIG. 7.

A lead-supplying pipe 32 is inserted into and connected to the front end of a small diameter front cylindrical portion 31 of the pipe holder 22. As shown in FIGS. 7–8, the pipe holder 22 has a flange 34 disposed rearwardly of the front cylindrical portion 31 via an intermediate portion 33. Disposed rearwardly of the flange 34 is an engagement projection 35 for engagement with the engagement hole 29 of the reservoir main body 21. Around the outer periphery of the front cylindrical portion 31 are provided an engagement groove 36 with which the engagement projection 19 of the chuck main body 12 is removably engageable, and a guide projection 37 for engagement with the stopper 23.

Figure 9:
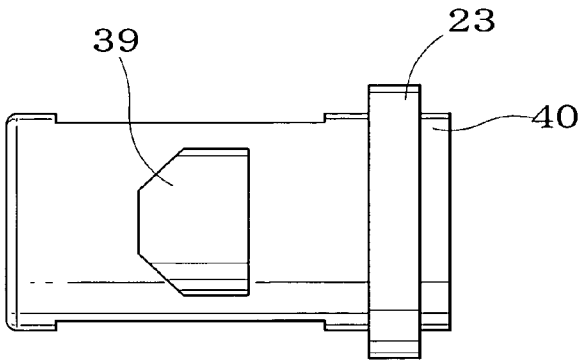
FIG. 9 is a front view of a stopper in the automatic mechanical pencil shown in FIG. 1.
Figure 10:
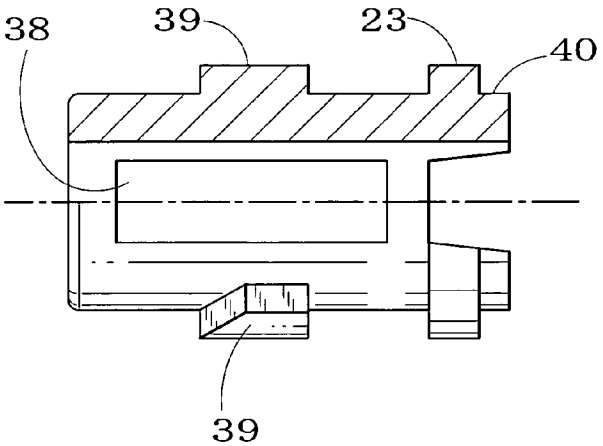
FIG. 10 is a partial cross-sectional side view of the stopper shown in FIG. 9.

The stopper 23 has, as shown in FIGS. 9–10, an axial receiving groove 38 extending in the axial direction and a connecting projection 39 having a shape configuration such that it enters the engagement hole 8 of the connecting cylinder 5 and engages with the engagement edges 7. The guide projection 37 of the pipe holder 22 is configured to fit into the receiving groove 38 for undergoing axial movement therein.

The knocking spring 24, which constitutes a second urging means, is mounted between a joining portion 40 formed at the rear part of the stopper 23 and the intermediate part 33 of the pipe holder 22. The knocking spring 24 urges the reservoir main body 21 backward and the stopper 23 forward so that the stopper and the reservoir main body can be moved relatively in the axial direction.

Figure 11:
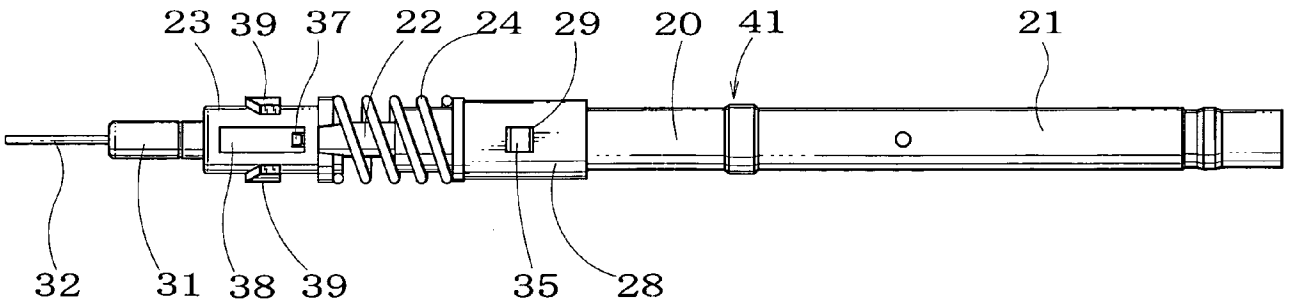
FIG. 11 is a front view of a primary unit body of the automatic mechanical pencil.

Assembly of the foregoing example of the automatic mechanical pencil according to the present invention is described below with reference to FIGS. 11–13.

First, the pipe holder 22 is joined with the front end of the reservoir main body 21, and the knocking spring 24 is attached thereto. Then the stopper 23 is inserted into the front cylindrical portion 31 of the pipe holder 22, and the guide projection 37 is engaged with the receiving groove 38. By this assembly method, a primary unit body 41, as shown in FIG. 11, is assembled in which the reservoir main body 21 and the stopper 23 are connected so that these are relatively movable in the axial direction.

Figure 12:
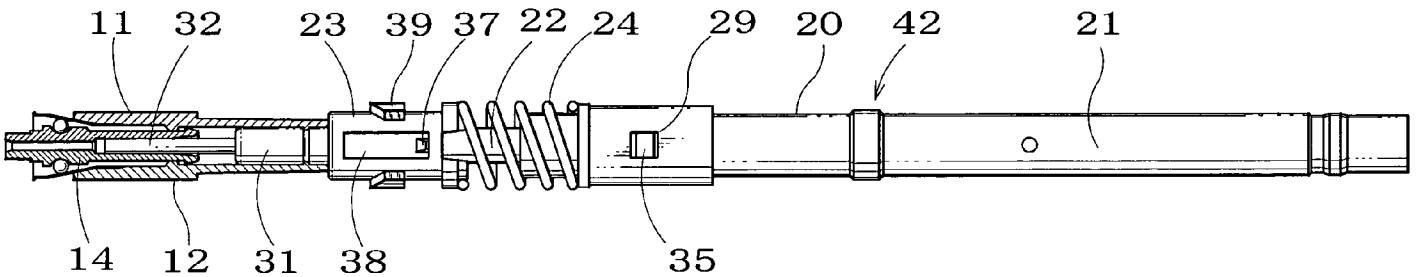
FIG. 12 is a front view of a secondary unit body of the automatic mechanical pencil with a lead chuck shown in cross-section.

A secondary unit body 42, as shown in FIG. 12, is then assembled by inserting the chuck main body 12 of the lead chuck 11 into the front cylindrical portion 31 of the pipe holder 22 of the primary unit body 41, and engaging the engagement projection 19 with the engagement groove 36.

Figure 13:
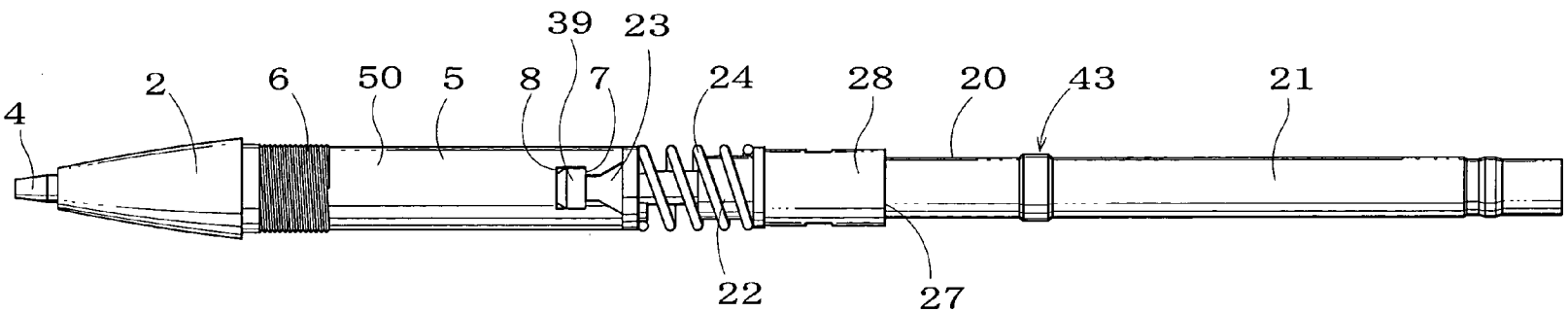
FIG. 13 is a front view of a tertiary unit body of the automatic mechanical pencil.

A tertiary unit body 43, as shown in FIG. 13, is then assembled by fitting the tubular piece 50, to which the slider 4 and the slider spring 3 are attached, around the outer periphery of the lead chuck 11, and by engaging the connecting projection 39 of the stopper 23 with the engagement hole 8 of the tubular piece 50. Thereafter, the connecting cylinder 5 of the tertiary unit body 43 is fitted into the barrel cylinder 1, and the barrel cylinder 1 is joined with the connecting cylinder 5, by threaded engagement between the threaded portions 1*a*, 6 of the barrel cylinder 1 and the connecting cylinder 5, under such condition that the outer stepped part 27 of the reservoir main body 21 abuts against the inner stepped part 30.

During use of the foregoing assembled automatic mechanical pencil, the writing pressure exerted when writing on a writing surface is sustained by the stopper 23, and the slider 4 retracts as the writing continues, and when the front end of the automatic mechanical pencil is released from the writing surface, the slider 4 advances by the action of the slider spring 3. Since the slider 4 frictionally holds the lead with the holding portion 10, the chuck elements 14,14 of the lead chuck 11 advance under such condition that the chuck elements grip the lead, and when the ball 15 transfers to the large diameter part of the ring 13, the grip of the lead is released, and the lead can be fed. Then, the chuck elements 14,14 retract by the action of the slider spring 3 and grip the lead when the ball 15 transfers to the small diameter part of the ring 13, by which the automatic mechanical pencil can be used to write on the writing surface.

When the rear end of the lead reservoir 20 is knocked via the knocking member 26, the lead chuck 11 connected to the pipe holder 22 advances until the ring 13 abuts against the stepped portion 9 of the tapered member 2, by which the lead can be fed. Since the rear end of the chuck main body 12 can be enlarged even when the transfer of the chuck main body 12 is stopped, the engagement projection 19 of the chuck main body 12 is disengaged from the engagement groove 36 of the pipe holder 22 and slidably moves on the outer surface of the front cylindrical part 31 of the pipe holder. When the front end of the lead-supplying pipe 32 abuts against the inner stepped portions 14*a* of the chuck elements 14,14, the chuck elements advance and release the grip of the lead. When the knocking of the lead reservoir 20 is stopped, the reservoir main body 21 retracts by the action of the knocking spring 24, and during retraction the chuck elements 14,14 grip the lead and, at the same time, the engagement projection 19 of the chuck main body 12 engages with the engagement groove 36 of the pipe holder 22, whereupon the lead chuck 11 is returned to such condition that the automatic mechanical pencil can be used to write on the writing surface.

It will be appreciated from the foregoing description that the present invention provides an automatic mechanical pencil which has a simple construction and a small number of parts so that it may be made economically and used in a convenient manner, and assembly can be made simply.

From the foregoing description, it can be seen that the present invention comprises an improved automatic mechanical pencil. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

What is claimed is:

1. An automatic mechanical pencil comprising:

a barrel cylinder having an inner stepped portion;

a tubular piece removably connected to the barrel cylinder and having a tapered member and a connecting cylinder extending rearwardly from a rear portion of the tapered member, the connecting cylinder having an engagement hole;

a slider for frictionally holding a lead and being movably disposed in a front portion of the tapered member to undergo movement in the axial direction of the barrel cylinder;

a lead chuck for releasably holding the lead so as to allow forward movement of the lead but prevent backward movement thereof, the lead chuck being movably disposed to undergo movement in an axial direction of the barrel cylinder;

a lead reservoir main body disposed in the barrel cylinder for supplying the lead to the lead chuck, the lead reservoir main body having an outer stepped portion for abutment with the inner stepped portion of the barrel cylinder;

a pipe holder connected to the lead chuck and to a front end of the lead reservoir main body and having a guide projection;

a stopper disposed around an outer periphery of the pipe holder, the stopper having a receiving groove engageable with the guide projection of the pipe holder and a connecting projection engageable with the engagement hole of the connecting cylinder;

first urging means for urging the slider forward and the lead chuck backward so that when a writing front end of the automatic mechanical pencil is released from a writing surface, the lead is automatically fed by urging the slider forward; and second urging means for urging the lead reservoir main body and the stopper so that the lead reservoir main body and the stopper move relatively in the axial direction.

2. An automatic mechanical pencil according to claim 1; wherein the pipe holder has an engagement groove; and wherein the lead chuck has an enlargeable end having an engagement projection engageable in the engagement groove of the pipe holder.

3. An automatic mechanical pencil according to claim 1; wherein the first urging means comprises a slider spring disposed between the slider and the lead chuck.

4. An automatic mechanical pencil according to claim 1; wherein the second urging means comprises a knocking spring disposed between the stopper and the lead reservoir main body.

5. An automatic mechanical pencil according to claim 1; wherein the lead reservoir main body is disposed to undergo movement in the axial direction; and the second urging means comprises a knocking spring disposed between the stopper and the lead reservoir main body and which urges the stopper forward and urges the lead reservoir main body backward.

6. An automatic mechanical pencil according to claim 1; wherein the tapered member and the connecting cylinder of the tubular piece define an integral structure formed from a single piece of material.

7. An automatic mechanical pencil according to claim 1; wherein the connecting cylinder has a first threaded portion for threaded engagement with a second threaded portion formed at a front end of the barrel cylinder.

8. An automatic mechanical pencil according to claim 7; wherein the first threaded portion is disposed between a front end of the connecting cylinder and the rear portion of the tapered member.

9. An automatic mechanical pencil according to claim 1; further comprising a knocking member engageable with the lead reservoir main body to effect forward axial movement of the lead reservoir main body.

10. An automatic mechanical pencil according to claim 9; wherein the knocking member is movably disposed at the rear end of the barrel cylinder and engages with the rear end of the lead reservoir main body.

11. A method for assembling an automatic mechanical pencil according to claim 1, comprising the steps of:

forming a primary unit body by connecting the pipe holder to the front end of the lead reservoir main body, fitting the second urging means and the stopper to an outer periphery of the pipe holder, and engaging the guide projection of the pipe holder with the receiving groove of the stopper so that the lead reservoir main body and the stopper are relatively movable in the axial direction;

forming a secondary unit body by connecting the lead chuck to the pipe holder of the primary unit body so as to allow forward movement of the lead but prevent backward movement thereof;

forming a tertiary unit body by mounting the tubular piece with its tapered member having the slider movably disposed therein around an outer periphery of the lead chuck; and connecting the barrel cylinder to the connecting cylinder of the tubular piece in the tertiary unit body.

12. An automatic mechanical pencil comprising:

a barrel cylinder;

a tubular piece removably connected to the barrel cylinder and having an engagement hole;

a slider for frictionally holding a lead and being movably disposed in a front portion of the tubular piece;

a lead chuck disposed in the barrel cylinder rearwardly of the slider for releasably holding the lead so as to allow forward movement of the lead but prevent backward movement thereof, the lead chuck being movably disposed to undergo movement in an axial direction of the barrel cylinder;

first urging means for urging the slider forward and the lead chuck backward so that when a writing front end of the writing instrument is released from a writing surface, the lead is automatically fed by urging the slider forward;

a lead reservoir disposed rearwardly of the lead chuck to supply the lead to the lead chuck, the lead reservoir comprising a reservoir main body, a pipe holder connected to a front end of the reservoir main body and having a guide projection, and a stopper disposed around an outer periphery of the pipe holder, the stopper having a receiving groove engageable with the guide projection of the pipe holder and a connecting projection engageable with the engagement hole of the tubular piece; and second urging means for urging the reservoir main body and the stopper of the lead reservoir so that the reservoir main body and the stopper move relatively in the axial direction of the barrel cylinder.

13. An automatic mechanical pencil according to claim 12; wherein the reservoir main body of the lead reservoir has an outer stepped portion for abutment with an inner stepped portion of the barrel cylinder.

14. An automatic mechanical pencil according to claim 12; wherein the pipe holder has an engagement groove; and wherein the lead chuck has an enlargeable end having an engagement projection engageable in the engagement groove of the pipe holder.

15. An automatic mechanical pencil according to claim 12; wherein the first urging means comprises a slider spring disposed between the slider and the lead chuck.

16. An automatic mechanical pencil according to claim 12; wherein the lead reservoir main body is disposed to undergo movement in the axial direction; and the second urging means comprises a knocking spring disposed between the stopper and the lead reservoir main body and which urges the stopper forward and urges the lead reservoir main body backward.

17. An automatic mechanical pencil according to claim 12; wherein the tubular piece comprises a tapered member in which the slider is disposed, and a connecting cylinder extending rearwardly from a rear portion of the tapered member.

18. An automatic mechanical pencil according to claim 17; wherein the tapered member and the connecting cylinder of the tubular piece define an integral structure formed from a single piece of material.

19. An automatic mechanical pencil according to claim 17; wherein the connecting cylinder has a first threaded portion for threaded engagement with a second threaded portion formed at a front end of the barrel cylinder.

20. An automatic mechanical pencil according to claim 19; wherein the first threaded portion is disposed between a front end of the connecting cylinder and the rear portion of the tapered member.

* * * * *